US008840202B2

(12) United States Patent
Garnett et al.

(10) Patent No.: US 8,840,202 B2
(45) Date of Patent: Sep. 23, 2014

(54) DISHWASHER APPLIANCE WITH A CONTOURED SILVERWARE BASKET

(75) Inventors: William Nathan Garnett, Ekron, KY (US); Anjuli B. Calvert, Louisville, KY (US); Daniel J. Hart, Louisville, KY (US)

(73) Assignee: General Electric Company, Schenectady, NY (US)

( * ) Notice: Subject to any disclaimer, the term of this patent is extended or adjusted under 35 U.S.C. 154(b) by 218 days.

(21) Appl. No.: 13/488,032

(22) Filed: Jun. 4, 2012

(65) Prior Publication Data

US 2013/0320825 A1 Dec. 5, 2013

(51) Int. Cl.
*A47B 77/08* (2006.01)
*A47B 81/00* (2006.01)

(52) U.S. Cl.
USPC ..... 312/228.1

(58) Field of Classification Search
CPC ..... A47L 15/502
USPC ..... 312/228.1, 321.5
See application file for complete search history.

(56) References Cited

U.S. PATENT DOCUMENTS

| | | | | |
|---|---|---|---|---|
| 4,834,125 | A * | 5/1989 | Insalaco | 134/201 |
| D391,696 | S | 3/1998 | Bournay, Jr. et al. | |
| 2005/0045215 | A1 | 3/2005 | Raches et al. | |
| 2006/0237053 | A1 * | 10/2006 | Bengston et al. | 134/58 D |
| 2009/0071514 | A1 * | 3/2009 | Roth | 134/56 D |
| 2010/0101611 | A1 * | 4/2010 | Chen et al. | 134/25.2 |

* cited by examiner

*Primary Examiner* — Darnell Jayne
*Assistant Examiner* — Timothy M Ayres
(74) *Attorney, Agent, or Firm* — Dority & Manning, PA

(57) ABSTRACT

A silverware basket for a dishwasher appliance is provided. The silverware basket is selectively mountable to a door of the dishwasher appliance, a rack assembly of the dishwasher appliance, or both. The silverware basket has a profile that is complementary to a contour of the door. The storage capacity of the silverware basket can be increased or maximized by matching the profile of the silverware basket to the contour of the door.

17 Claims, 6 Drawing Sheets

FIG. –1–

DISHWASHER APPLIANCE WITH A CONTOURED SILVERWARE BASKET

FIELD OF THE INVENTION

The present subject matter relates generally to dishwasher appliances and silverware baskets for the same.

BACKGROUND OF THE INVENTION

Dishwasher appliances generally include a wash tub that defines a wash chamber. A rack assembly can be slidably received within the wash chamber and configured for receipt of articles (e.g., plates, cups, and/or bowls) for washing. Certain dishwasher appliances also include a silverware basket configured for receipt of articles (e.g., forks, knives, spoons, and/or other utensils) for washing.

The silverware basket can be mounted in various positions within a dishwasher appliance. For example, the silverware basket is mounted within the rack assembly in certain dishwasher appliances. In other dishwasher appliances, the silverware basket is mounted on a front of the rack assembly or on a door of the appliance. However, each position for the silverware basket has drawbacks. For example, certain consumers can perceive the dishwasher appliance as having a greater capacity when the silverware basket is mounted to the front of the rack assembly rather than within the rack assembly. Conversely, certain consumers prefer the cosmetic appearance of the silverware basket mounted to the door of the dishwasher appliance compared to on the front of the rack assembly.

Accordingly, a silverware basket for a dishwasher appliance that may be mounted in multiple positions within the dishwasher appliance would be useful.

Silverware baskets are preferably sized to hold a maximum number of utensils to maximize the capacity of the dishwasher appliance. Such a configuration can improve consumer satisfaction with the silverware basket or provide improved consumer perception of the dishwasher appliance. However, silverware baskets are generally constructed with a simple rectangular prismatic shape. Such a configuration generally does not have an optimum shape to utilize available space within the dishwasher appliance.

Accordingly, a silverware basket for a dishwasher appliance with features for increasing or maximizing storage capacity of the silverware basket would be useful.

BRIEF DESCRIPTION OF THE INVENTION

The present subject matter provides a silverware basket for a dishwasher appliance. The silverware basket is selectively mountable to a door of the dishwasher appliance, a rack assembly of the dishwasher appliance, or both. The silverware basket has a profile that is complementary to a contour of the door. The storage capacity of the silverware basket can be increased or maximized by matching the profile of the silverware basket to the contour of the door. Additional aspects and advantages of the invention will be set forth in part in the following description, or may be apparent from the description, or may be learned through practice of the invention.

In a first exemplary embodiment, a dishwasher appliance is provided. The dishwasher appliance includes a tub that defines a wash chamber. The tub extends between a first side and a second side along a lateral direction. The tub also extends between a front and a back along a transverse direction. The transverse direction is perpendicular to the lateral direction. A door is mounted proximate the tub. The door permits selective access to the wash chamber of tub. An interior surface of the door has a contour along the lateral direction when the door is in a closed position. The contour has an obtuse angle. A rack assembly is mounted within the wash chamber and is configured for receipt of articles for cleaning A silverware basket is removably mounted to a front of the rack assembly such that the silverware basket is disposed between the rack assembly and the door along the transverse direction when the door is in the closed position. The silverware basket has an outer profile along the lateral direction that is complementary to the contour of the door.

In a second exemplary embodiment, a dishwasher appliance is provided. The dishwasher appliance includes a tub that defines a wash chamber. The tub extends between a first side and a second side along a lateral direction. The tub also extends between a front and a back along a transverse direction. The transverse direction is perpendicular to the lateral direction. A door is mounted proximate the tub. The door permits selective access to the wash chamber of the tub. An interior surface of the door has a contour along the lateral direction when the door is in a closed position. The contour has an obtuse angle. A silverware basket is removably mounted to the door. The silverware basket has an inner profile along the lateral direction that is complementary to the contour of the door.

In a third exemplary embodiment, a dishwasher appliance is provided. The dishwasher appliance includes a tub that defines a wash chamber. The tub extends between a first side and a second side along a lateral direction. The tub also extends between a front and a back along a transverse direction. The transverse direction is perpendicular to the lateral direction. A door is mounted proximate the tub. The door permits selective access to the wash chamber of the tub. An interior surface of the door has a contour along the lateral direction when the door is in a closed position. The contour has an obtuse angle. A rack assembly is mounted within the wash chamber and configured for receipt of articles for cleaning. A silverware basket has an outer profile along the lateral direction that is complementary to the contour of the door. The silverware basket also has an inner profile along the lateral direction that is complementary to the contour of the door. The silverware basket is removably mounted within the wash chamber of the tub in either a first configuration or a second configuration depending upon the configuration selected for dishwasher operations. In the first configuration, the silverware basket is mounted to a front of the rack assembly such that the silverware basket is disposed between the rack assembly and the door along the transverse direction when the door is in the closed position. In the second configuration, the silverware basket is mounted to the door.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
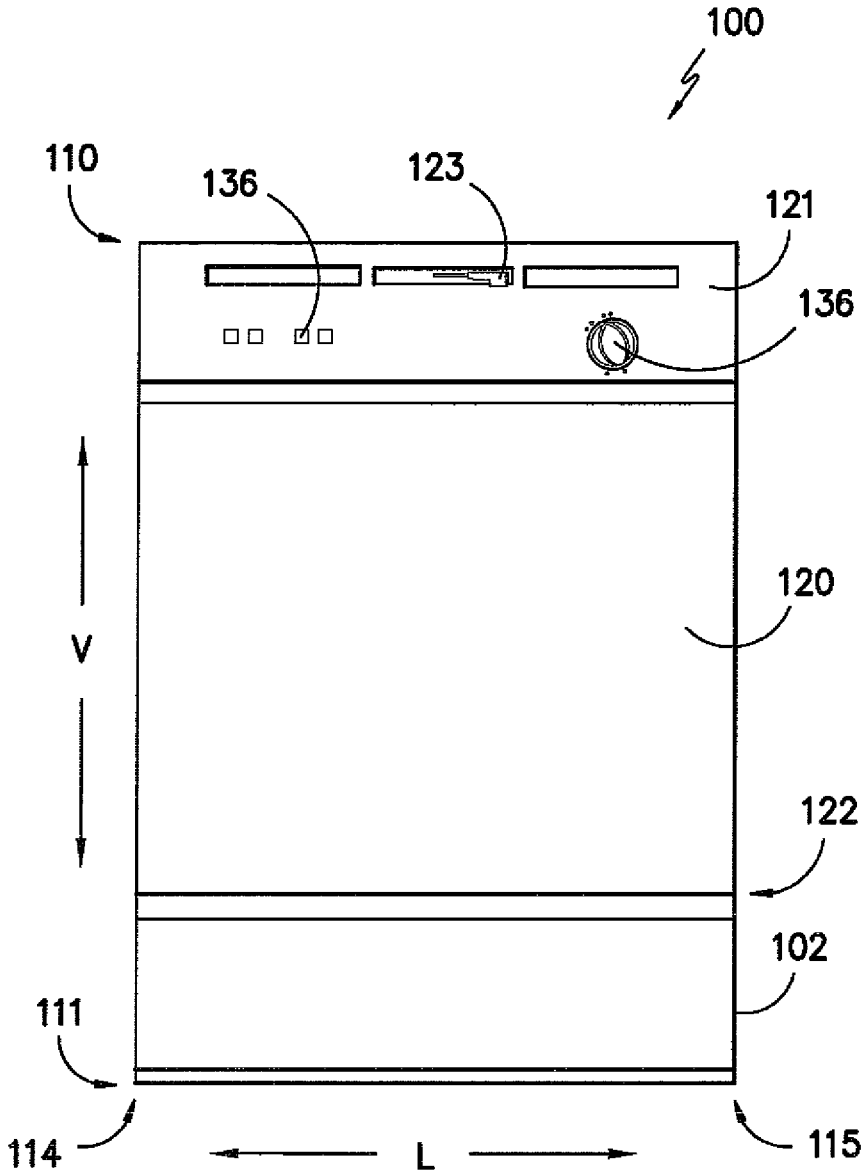
FIG. 1 provides a front view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
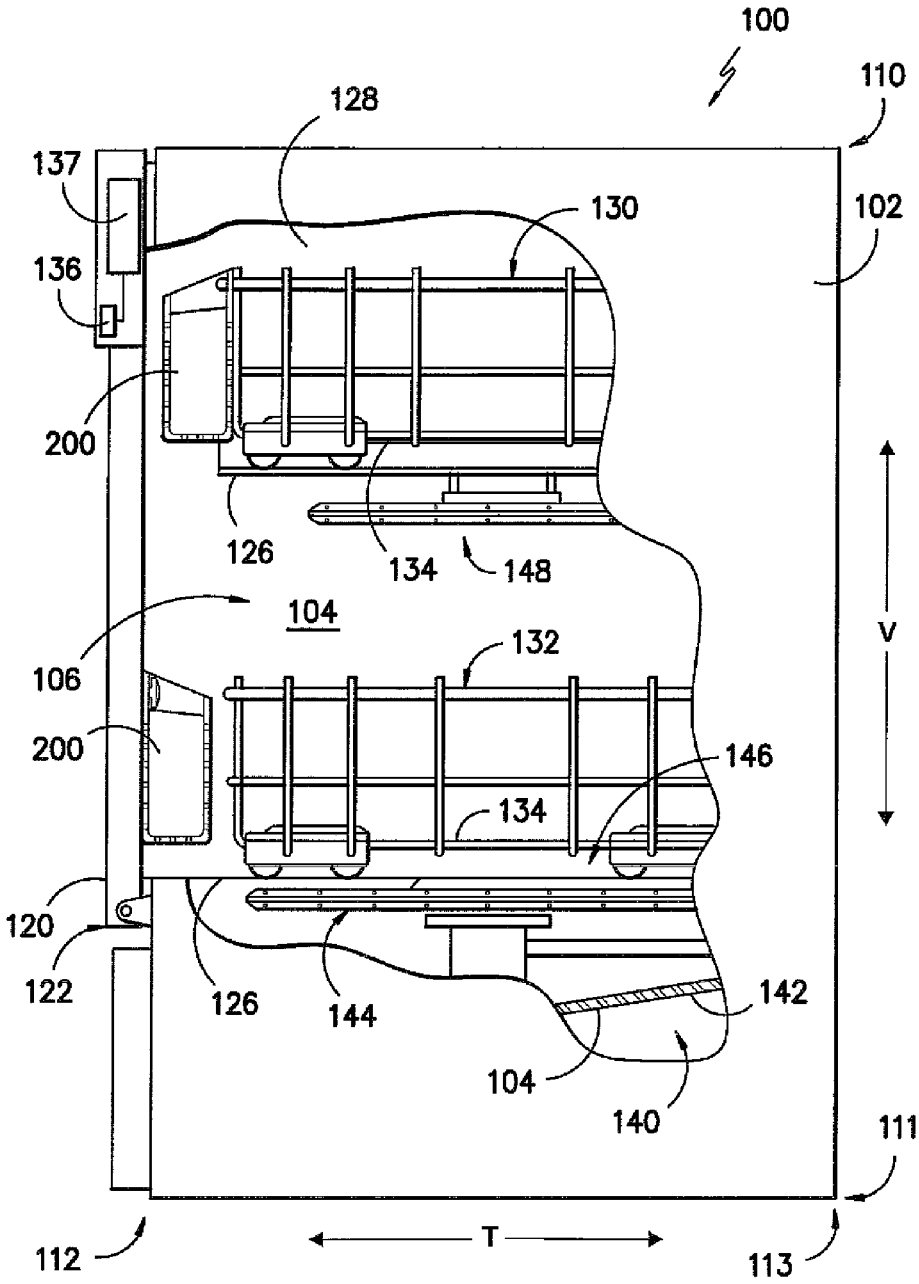
FIG. 2 illustrates a side view of the dishwasher appliance of FIG. 2 with portions of a cabinet of the dishwasher appliance removed to illustrate a wash chamber of the cabinet.

FIGS. 1 and 2 depict an exemplary domestic dishwasher 100 that may be configured in accordance with aspects of the present disclosure. The dishwasher 100 includes a cabinet 102 having a tub 104 (FIG. 2) therein that defines a wash chamber 106 (FIG. 2). The tub 104 includes a door 120 hinged at its bottom 122 for movement between a normally closed position (shown in FIGS. 1 and 2), wherein the wash chamber 106 is sealed shut (e.g., for washing operation), and an open position (e.g., for loading and unloading of articles from the dishwasher 100). A latch 123 (FIG. 1) is used to lock and unlock the door 120 for access to the chamber 106.

As may be seen in FIG. 1, dishwasher appliance 100 extends between a top 110 and a bottom 111 along a vertical direction V and also extend between a first side 114 and a second side 115 along a lateral direction L. As may be seen in FIG. 2, dishwasher appliance 100 also extends between a front 112 and a back 113 along a transverse direction T. Transverse direction T is substantially perpendicular to lateral and vertical directions L, V. Thus, vertical direction V, lateral direction L, and transverse direction T form an orthogonal directional system.

Guide rails 126 are mounted on tub side walls 128 and accommodate upper and lower rack assemblies 130, 132. Each of the upper and lower rack assemblies 130, 132 is fabricated from lattice structures that include a plurality of elongated members 134. Each rack assembly 130, 132 is adapted for movement between an extended loading position (not shown) in which the rack is substantially positioned outside the wash chamber 106, and a retracted position (shown in FIGS. 1 and 2) in which the rack is located within the wash chamber 106.

A pair of silverware baskets 200 is removably mounted to upper rack assembly 130 and door 120 respectively. However, silverware baskets 200 may also be selectively attached to other portions of dishwasher 100, e.g., lower rack assembly 132. Silverware baskets 200 are configured for receipt of silverware, utensils, and the like, that are too small to be accommodated by the upper and lower rack assemblies 130, 132. Silverware baskets 200 may be constructed of any suitable material, e.g., metal or plastic, and are discussed in greater detail below.

The dishwasher 100 further includes a lower spray assembly 144 that is mounted within a lower region 146 of the wash chamber 106 and above a tub sump portion 142 so as to be positioned in relatively close proximity to the lower rack assembly 132. A mid-level spray assembly 148 is located in an upper region of the wash chamber 106 and may be located in close proximity to upper rack assembly 130. Additionally, an upper spray assembly (not shown) may be located above the upper rack assembly 130.

The lower and mid-level spray assemblies 144, 148 and the upper spray assembly are fed by a fluid circulation assembly (not shown) for circulating water and dishwasher fluid in the tub 104. Portions of the fluid circulation assembly may be located in a machinery compartment 140 located below the bottom sump portion 142 of the tub 104, as generally recognized in the art. Each spray assembly includes an arrangement of discharge ports or orifices for directing washing liquid onto dishes or other articles located in the upper and lower rack assemblies 130, 132, respectively and silverware basket 200. The arrangement of the discharge ports in at least the lower spray assembly 144 provides a rotational force by virtue of washing liquid flowing through the discharge ports. The resultant rotation of the lower spray assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 137 may be positioned in a variety of locations throughout dishwasher 100. In the illustrated exemplary embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one exemplary embodiment, the user interface 136 may represent a general purpose I/O ("GPIO") device or functional block. In one exemplary embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher and that the exemplary embodiment depicted in FIGS. 1 and 2 is for illustrative purposes only. For example, the present subject matter may be used in dishwasher appliances having other rack configurations.

Figure 3:
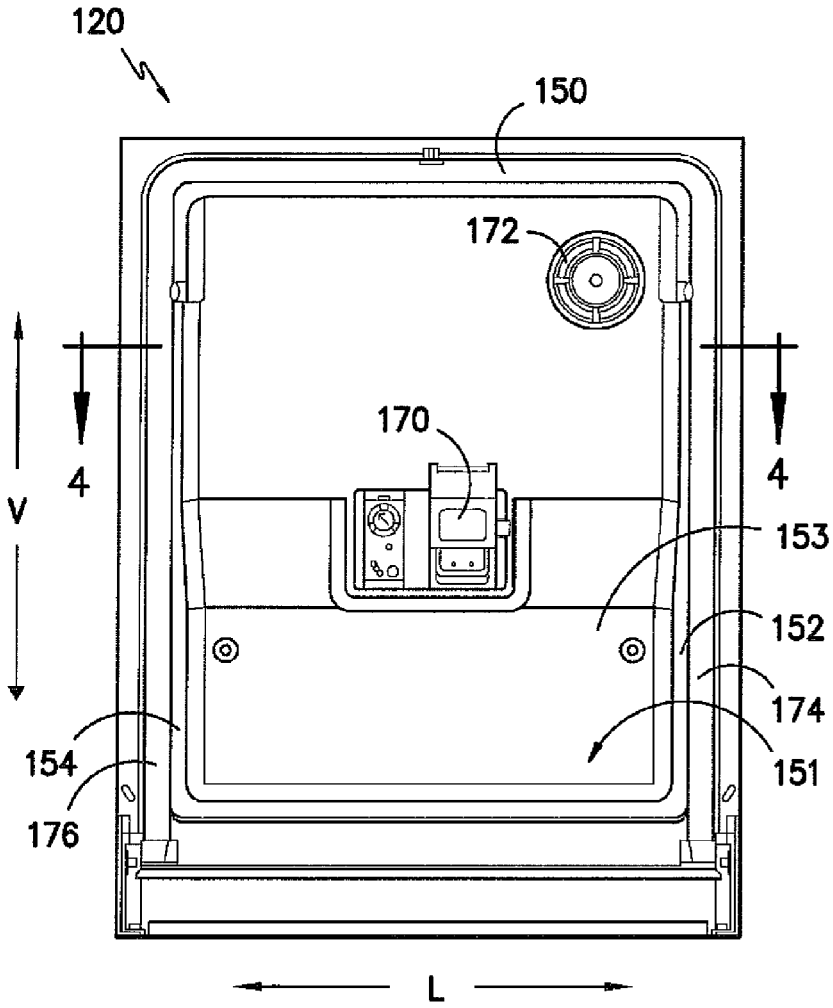
FIG. 3 is a rear view of a door of the dishwasher appliance of FIG. 1.
Figure 4:
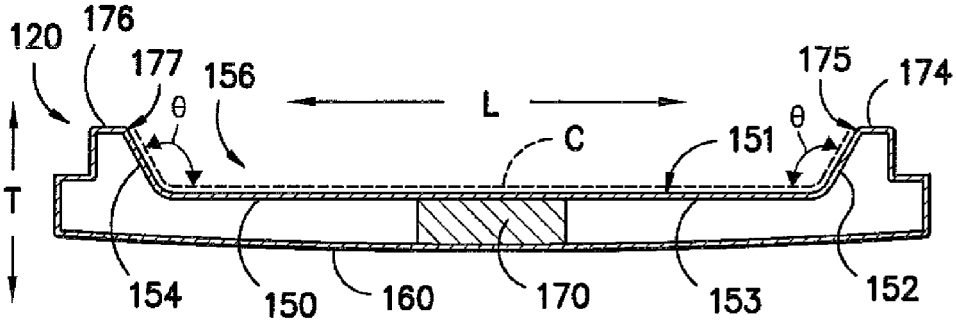
FIG. 4 provides a cross-sectional view of the door of FIG. 3 taken along the 4-4 line of FIG. 3.

FIG. 3 is a rear view of door 120 of dishwasher appliance 100 (FIG. 1). FIG. 4 provides a cross-sectional view of door 120 taken along the 4-4 line of FIG. 3. As may be seen in FIG. 4, door 120 includes an inner door panel 150 coupled or secured to an outer door panel 160. Turning now to FIG. 3, inner door panel 150 includes a detergent dispenser 170 mounted to inner door panel 150. A user can fill detergent dispenser 170 with detergent prior to starting dishwasher appliance 100 (FIG. 1), and detergent dispenser 170 may dispense such detergent during operation of dishwasher appliance 100. Inner door panel 150 also includes a vent 172 that is in fluid communication with wash chamber 106 of tub 104 (FIG. 2). Water vapor and/or steam can be directed out of wash chamber 106 through vent 172, e.g., during a drying cycle of dishwasher appliance 100.

As best seen in FIG. 4, inner door panel 150 also includes a first sidewall 152 and a second sidewall 154. First and second sidewalls 152 and 154 are spaced apart by a connecting portion 153 along the lateral direction L such that connecting portion 153 extends between and connects first and second sidewalls 152 and 154. In FIGS. 3 and 4, connecting portion 153 is substantially flat or linear along the lateral direction L. However, in alternative embodiments, connecting portion 153 may have any suitable shape along the lateral direction L, e.g., arcuate, parabolic, or angular.

A first flange 174 extends along the lateral direction L from a distal end 175 of first sidewall 152. Similarly, a second flange 176 extends along the lateral direction L from a distal end 177 of second sidewall 154. First and second flanges 174 and 176 engage with tub 104 (FIG. 2) when door 120 is in the closed position in order to assist in sealing wash chamber 106 (FIG. 2). A seal or gasket (not shown) may be mounted to first and second flanges 174 and 176 or to tub 104 to assist such sealing.

In the exemplary embodiment shown in FIGS. 3 and 4, first and second sidewalls 152 and 154 do not extend away from connecting portion 153 at a right angle, i.e.—ninety degrees. In particular, first and second sidewalls 152 and 154 extend away from connecting portion 153 at an angle θ. As used herein, angle θ is the angle between first and second sidewalls 152 and 154 and connecting portion 153 respectively.

As best seen in FIG. 4, first and second sidewalls 152 and 154 and connecting portion 153 of inner door panel 150 define a contour, shown with dashed line C, on an interior surface 151 of door 120. Contour C includes the angle θ due to sidewalls 152 and 154 extending away from connecting portion 153 in the manner described above. Further, contour C, as viewed along its profile in the vertical direction, has no right angles or acute angles. Instead, angle θ is obtuse or greater than 90 degrees. For example, angle θ is about one hundred and twenty-five degrees in FIG. 4. However, it should be understood that angle θ may be any suitable angle, e.g., between about one hundred and forty degrees and about one hundred and fifty degrees, between about one hundred and thirty degrees and about one hundred and sixty degrees, between about one hundred and twenty degrees and about seventy degrees, or between about ninety degrees and about one hundred and seventy-five degrees. Thus, it should be understood that contour C shown in FIG. 4 is provided by way of example only. As discussed above, in alternative exemplary embodiments, first and second sidewalls 152 and 154 may extend from connecting portion 153 at various angles. In such exemplary embodiments, contour C changes accordingly.

Inner door panel 150 also defines a pocket 156 that extends into door 120 along transverse direction T when door 120 is in the closed position. In particular, first and second sidewalls 152 and 154 and connecting portion 153 of inner door panel 150 define pocket 156. Pocket 156 receives silverware basket 200 (FIG. 2) when door 120 is in the closed position as describe in greater detail below.

Figure 5:
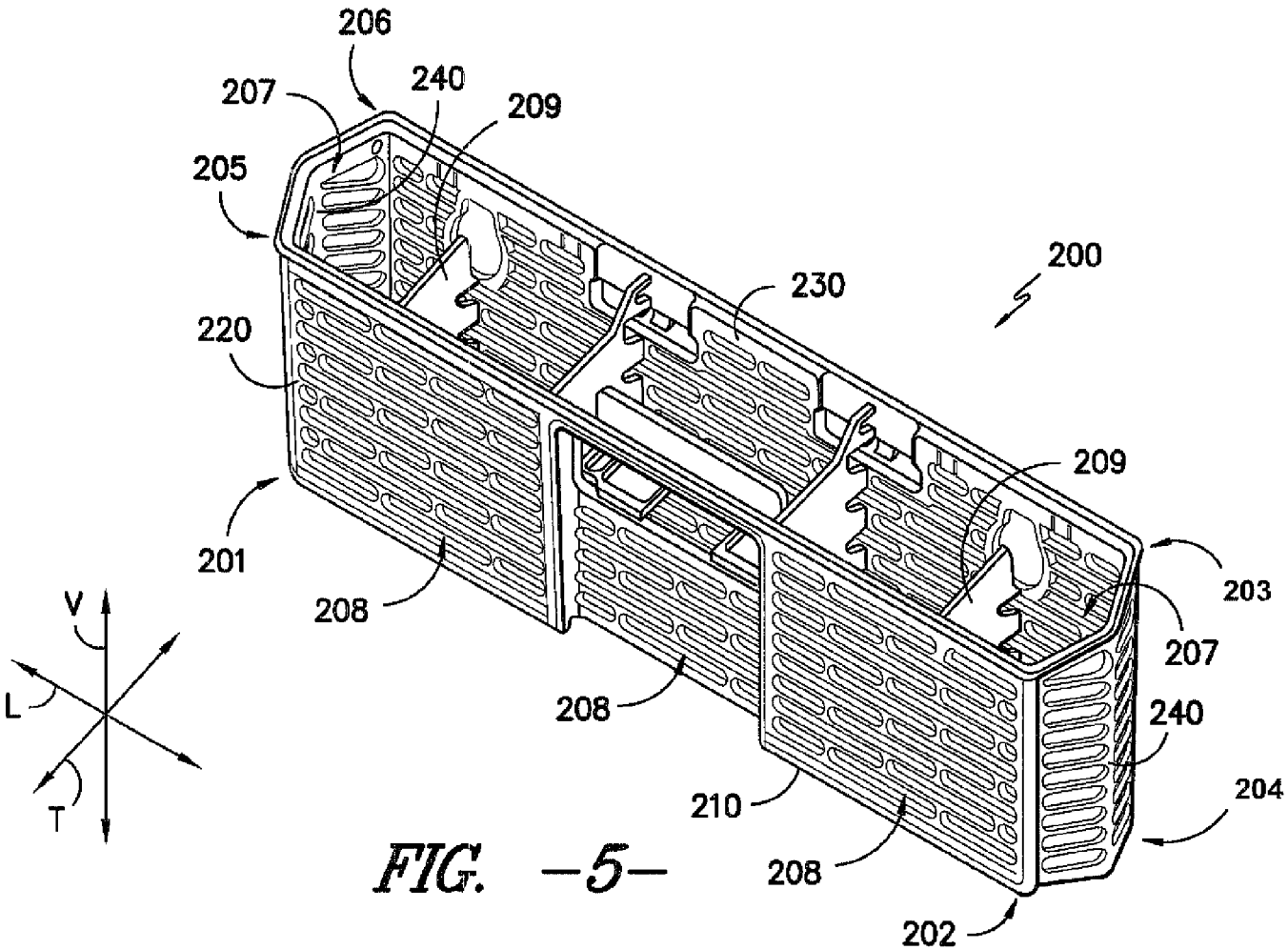
FIG. 5 illustrates a perspective view of a silverware basket according to an exemplary embodiment of the present subject matter.
Figure 6:
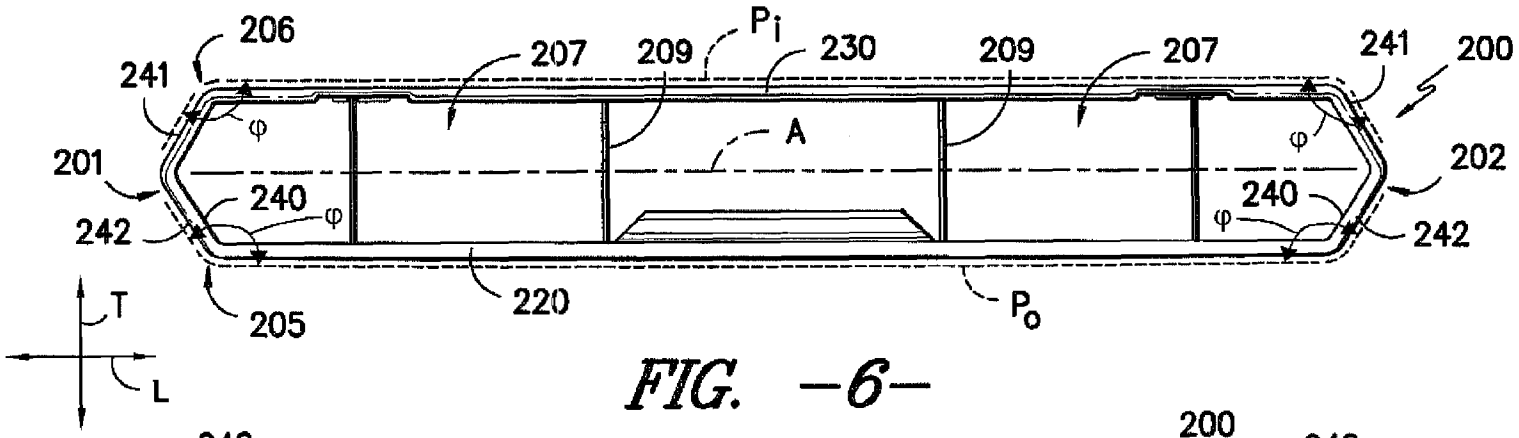
FIG. 6 provides a top view of the silverware basket of FIG. 5 with a bottom wall of the silverware basket removed for clarity.
Figure 7:
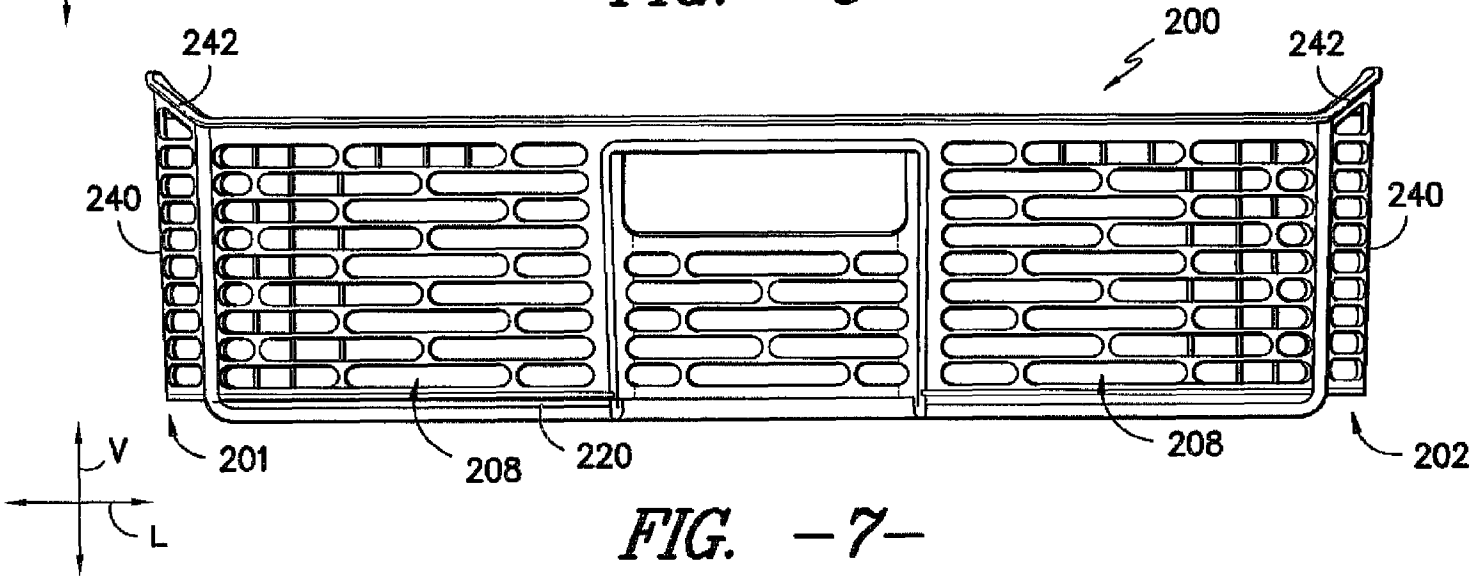
FIG. 7 provides a front view of the silverware basket of FIG. 5 with a back wall of the silverware basket removed for clarity.

FIG. 5 illustrates a perspective view of silverware basket 200. FIG. 6 provides a top view of silverware basket 200 with a bottom wall 230 of silverware basket 200 removed for clarity. FIG. 7 provides a front view of silverware basket 200 with a back wall 230 of silverware basket 200 removed for clarity.

When silverware basket 200 is mounted within wash chamber 106 (FIG. 2), silverware basket 200 extends between a first side 201 and a second side 202 along the lateral direction L. Silverware basket 200 further extends between a top 203 and a bottom 204 along the vertical direction V and between a front 205 and a back 206 along the transverse direction T when silverware basket 200 is mounted within wash chamber 106.

As may be seen in FIG. 6, silverware basket 200 includes a bottom wall 210. A front wall 220 extends from bottom wall 210 along the vertical direction V. Similarly, a back wall 230 extends from bottom wall 210 along the vertical direction V. Back wall 230 and front wall 220 are spaced apart along the transverse direction T. Silverware basket 200 also includes a pair of opposing transverse walls 240 mounted on first and second sides 201 and 202 of silverware basket 200 respectively. Transverse walls 240 extend between and connect front wall 220 and back wall 230 along the transverse direction T.

Dividers 209 also extend between front wall 220 and back wall 230 along the transverse direction T. Bottom wall 210, front wall 220, back wall 230, transverse walls 240, and dividers 209 assist in defining a plurality of cavities 207 configured for receipt of articles (e.g., forks, knives, spoons, and/or other utensils). Bottom wall 210, front wall 220, back wall 230, and transverse walls 240 also define a plurality of holes 208. Plurality of holes 208 permit wash fluid to flow into and out of cavities 207, e.g., during operation of dishwasher appliance 100. Plurality of holes 208 also permit a flow of air through cavities 207, e.g., to assist in drying articles therein.

As best seen in FIG. 6, transverse walls 240 of silverware basket 200 have a dihedral shape with a first segment 241 and a second segment 242. In FIG. 6, first segment 241 and second segment 242 of transverse walls 240 meet at an angle of about one hundred and fifteen degrees. However, in alternative exemplary embodiments, first segment 241 and second segment 242 of transverse walls 240 may meet at any suitable angle, e.g., between about one hundred and ten degrees and about one hundred and twenty degrees or between about one hundred degrees and about one hundred and thirty degrees.

In the exemplary embodiment shown in FIG. 6, first segment 241 and second segment 242 of transverse walls 240 are substantially equilateral, i.e.—both first and second segments 241 and 242 are about the same length. Because transverse walls 240 are equilateral and have a dihedral shape, silverware basket 200 is substantially symmetrical about an axis A that extends along the lateral direction L.

As best seen in FIG. 6, silverware basket 200 has an inner profile, shown with dashed line $P_i$, and an outer profile, shown with dashed line $P_o$. In particular, inner profile $P_i$ is defined by back wall 230 and first segment 241 of transverse walls 240. Similarly, outer profile $P_o$ is defined by front wall 220 and second segment 242 of transverse walls 240. Inner profile $P_i$ and outer profile $P_i$ are spaced apart, e.g., along the transverse direction T when silverware basket 200 is mounted within wash chamber 106 (FIG. 2).

In FIG. 6, inner profile $P_i$ and outer profile $P_i$ are substantially similar. However, in alternative exemplary embodiments, inner profile $P_i$ and outer profile $P_i$ may have different shapes, e.g., due to variations in lengths of first and second segments 241 and 242 of transverse walls 240. As discussed in greater detail below, inner profile $P_i$ and outer profile $P_i$ of silverware basket 200 are complementary to contour C of inner door panel 150 (FIG. 4).

Inner profile $P_i$ and outer profile $P_i$ have angles $\phi$. As used herein, angle $\phi$ is the angle between first or second segments 241 and 242 of transverse walls 240 and front wall 220 or back wall 230 respectively. Like contour C (FIG. 4), inner profile $P_i$ and outer profile $P_i$, as viewed along their profile in the vertical direction, have no right angles or acute angles. Instead, angle $\phi$ is obtuse or greater than 90 degrees. For example, angle $\phi$ is about one hundred and twenty-five degrees in FIG. 6. However, it should be understood that angle $\phi$ may be any suitable angle, e.g., between about one hundred and forty degrees and about one hundred and fifty degrees, between about one hundred and thirty degrees and about one hundred and sixty degrees, between about one hundred and twenty degrees and about seventy degrees, or between about ninety degrees and about one hundred and seventy-five degrees. Thus, it should be understood that inner profile $P_i$ and outer profile $P_i$ shown in FIG. 6 are provided by way of example only and may vary in alternative embodiments, e.g., depending upon the angle between first or second segments 241 and 242 of transverse walls 240 and front and back walls 220 and 230 respectively.

Figure 8:
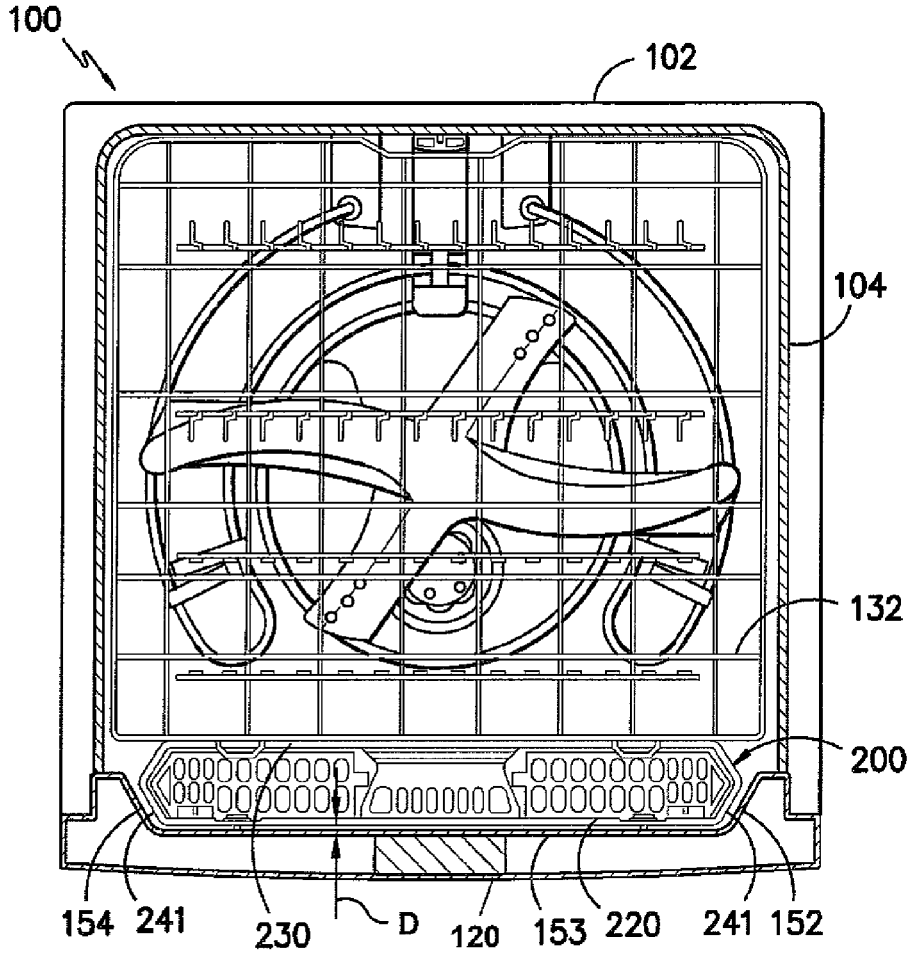
FIG. 8 illustrates a top, cross-sectional view of the dishwasher appliance of FIG. 1 with the silverware basket of FIG. 5 mounted to a bottom rack assembly of the dishwasher appliance.
Figure 9:
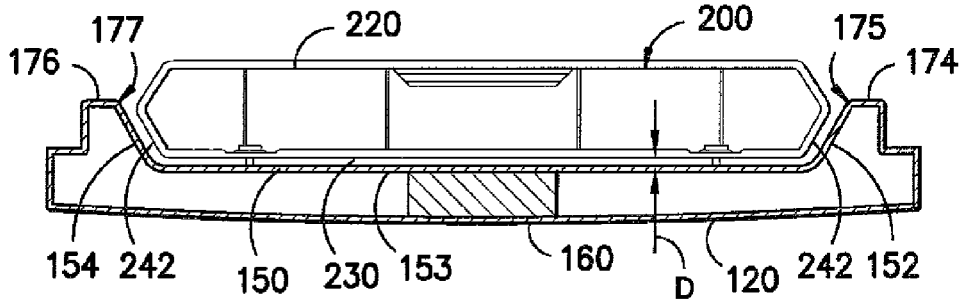
FIG. 9 illustrates a top, cross-sectional view of the door of FIG. 3 taken along the 4-4 line of FIG. 3 with the silverware basket of FIG. 5 mounted to the door.

FIG. 8 illustrates a top, cross-sectional view of dishwasher appliance 100 with silverware basket 200 mounted to lower rack assembly 132. FIG. 9 illustrates a top, cross-sectional view of door 120 with silverware basket 200 mounted thereto. In FIGS. 8 and 9, silverware basket 200 is received within pocket 156 (FIG. 4) of door 120. In particular, because outer profile $P_o$ (FIG. 6) and inner profile $P_i$ (FIG. 6) of silverware basket 200 are complementary to contour C (FIG. 4) of inner door panel 150, silverware basket 200 is received within pocket 156 of door 120 in a complementary or nested manner as described in greater detail below.

As may be seen in FIG. 8, when silverware basket 200 is mounted to lower rack assembly 132, front wall 220 of silverware basket 200 is positioned adjacent connecting portion 153 of inner door panel 150, and first segment 241 of transverse walls 240 of silverware basket 200 is positioned adjacent first and second sidewalls 152 and 154 of inner door panel 150 respectively. In particular, front wall 220 of silverware basket 200 apposes or faces connecting portion 153 of inner door panel 150, and first segment 241 of transverse walls 240 of silverware basket 200 apposes or faces first and second sidewalls 152 and 154 of inner door panel 150 respectively. Similarly, as may be seen in FIG. 9, when silverware basket 200 is mounted to door 120, back wall 230 of silverware basket 200 is positioned adjacent connecting portion 153 of inner door panel 150, and second segment 242 of transverse walls 240 of silverware basket 200 is positioned adjacent first and second sidewalls 152 and 154 of inner door panel 150 respectively. In particular, back wall 230 of silverware basket 200 apposes or faces connecting portion 153 of inner door panel 150, and second segment 242 of transverse walls 240 of silverware basket 200 apposes or faces first and second sidewalls 152 and 154 of inner door panel 150 respectively.

Further, as may be seen in FIG. 8, when silverware basket 200 is mounted to lower rack assembly 132, connecting portion 153 of inner door panel 150 is spaced apart from front wall 220 of silverware basket 200 by about a distance D, and first and second sidewalls 152 and 154 of inner door panel 150 are spaced apart from first second segment 241 of transverse walls 240 by about distance D as well. Similarly, as may be seen in FIG. 9, when silverware basket 200 is mounted to door 120, connecting portion 153 of inner door panel 150 is spaced apart from back wall 230 of silverware basket 200 by about distance D, and first and second sidewalls 152 and 154 of inner door panel 150 are spaced apart from second segment 242 of transverse walls 240 by about distance D as well.

By constructing silverware basket 200 such that outer and inner profiles $P_o$ and $P_i$ (FIG. 6) of silverware basket 200 are complementary to contour C (FIG. 4) of inner door panel 150, consumer satisfaction with silverware basket 200 can be improved. For example, such a configuration can permit silverware basket 200 to store greater numbers of utensils. In particular, because outer and inner profiles $P_o$ and $P_i$ of silverware basket 200 are complementary to contour C of inner door panel 150, silverware basket 200 can occupy an increased or maximum volume within pocket 156 of door 120. In turn, storage volume within plurality of cavities 207 can be increased or maximized by utilizing the available space within pocket 156.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a tub that defines a wash chamber, said tub extending between a first side and a second side along a lateral direction, said tub also extending between a front and a back along a transverse direction, the transverse direction being perpendicular to the lateral direction;

a door mounted proximate said tub for permitting selective access to the wash chamber of said tub, an interior surface of said door having a contour along the lateral direction when said door is in a closed position, the contour having an obtuse angle;

a rack assembly mounted within the wash chamber and configured for receipt of articles for cleaning; and a silverware basket removably mounted to a front of said rack assembly such that said silverware basket is disposed between said rack assembly and said door along the transverse direction when said door is in the closed position, said silverware basket having an outer profile along the lateral direction that is complementary to the contour of said door, said silverware basket also having an inner profile along the lateral direction that is complementary to the contour of said door, said silverware basket comprising a back wall;

a front wall spaced apart from said back wall; and a pair of transverse walls extending between and connecting said back wall and said front wall;

wherein, said front wall and said pair of transverse walls define the outer profile of said silverware basket, said front wall forming an angle $\phi_1$ with a first portion of each of said transverse walls, wherein the angle $\phi_1$ is greater than ninety degrees; and wherein, said back wall and said pair of transverse walls define the inner profile of said silverware basket, said back wall forming an angle $\phi_2$ with a second portion of each of said transverse walls, wherein the angle $\phi_2$ is greater than ninety degrees.

2. The dishwasher appliance of claim 1, wherein said door comprises:

an inner door panel, said inner door panel comprising:

a connecting portion; and a pair of sidewalls that extend away from said connecting portion along the transverse direction when said door is in the closed position;

wherein, said connecting portion and said pair of sidewalls define the contour of said door.

3. The dishwasher appliance of claim 2, wherein said connecting portion forms an angle $\theta$ with each of said sidewalls, wherein the angle $\theta$ is greater than ninety degrees.

4. The dishwasher appliance of claim 1, wherein said front wall forms an angle $\phi$ with each of said transverse walls, wherein the angle $\phi$ is greater than one hundred and twenty degrees.

5. The dishwasher appliance of claim 1, wherein said front wall is positioned adjacent and faces said inner door panel and at least a portion of each of said pair of transverse walls is positioned adjacent and faces a respective one of said pair of sidewalls.

6. The dishwasher appliance of claim 1, wherein said front wall is spaced apart from said inner door panel by a fixed distance and at least a portion of each of said pair of transverse walls is spaced apart from a respective one of said pair of sidewalls by about the same amount as the fixed distance.

7. A dishwasher appliance comprising:

a tub that defines a wash chamber, said tub extending between a first side and a second side along a lateral direction, said tub also extending between a front and a back along a transverse direction, the transverse direction being perpendicular to the lateral direction;

a door mounted proximate said tub for permitting selective access to the wash chamber of said tub, an interior surface of said door having a contour along the lateral direction when said door is in a closed position, the contour having an obtuse angle;

a silverware basket removably mounted to said door, said silverware basket having an inner profile along the lateral direction that is complementary to the contour of said door, said silverware basket also having an inner profile along the lateral direction that is complementary to the contour of said door, said silverware basket comprising a back wall;

a front wall spaced apart from said back wall; and a pair of transverse walls extending between and connecting said back wall and said front wall;

wherein, said front wall and said pair of transverse walls define the outer profile of said silverware basket, said front wall forming an angle $\phi_1$ with a first portion of each of said transverse walls, wherein the angle $\phi_1$ is greater than ninety degrees; and wherein, said back wall and said pair of transverse walls define the inner profile of said silverware basket, said back wall forming an angle $\phi_2$ with a second portion of each of said transverse walls, wherein the angle $\phi_2$ is greater than ninety degrees.

8. The dishwasher appliance of claim 7, wherein said door comprises:

an inner door panel, said inner door panel comprising:

a connecting portion; and a pair of sidewalls that extend away from said connecting portion along the transverse direction when said door is in the closed position;

wherein, said connecting portion and said pair of sidewalls define the contour of said door.

9. The dishwasher appliance of claim 8, wherein said connecting portion forms an angle $\theta$ with each of said sidewalls, wherein the angle $\theta$ is greater than ninety degrees.

10. The dishwasher appliance of claim 7, wherein said back wall forms an angle $\phi$ with each of said transverse walls, wherein the angle $\phi$ is greater than one hundred and twenty degrees.

11. The dishwasher appliance of claim 7, wherein said back wall is positioned adjacent and faces said connecting portion and at least a portion of each of said pair of transverse walls is positioned adjacent and faces a respective one of said pair of sidewalls.

12. The dishwasher appliance of claim 7, wherein said back wall is spaced apart from said inner door panel by a set distance and at least a portion of each of said pair of transverse walls is spaced apart from a respective one of said pair of sidewalls by about the same amount as the set distance.

13. A dishwasher appliance comprising:

a tub that defines a wash chamber, said tub extending between a first side and a second side along a lateral direction, said tub also extending between a front and a back along a transverse direction, the transverse direction being perpendicular to the lateral direction;

a door mounted proximate said tub for permitting selective access to the wash chamber of said tub, an interior surface of said door having a contour along the lateral direction when said door is in a closed position, the contour having an obtuse angle;

a rack assembly mounted within the wash chamber and configured for receipt of articles for cleaning; and a silverware basket having an outer profile along the lateral direction that is complementary to the contour of said door, said silverware basket also having an inner profile along the lateral direction that is complementary to the contour of said door, said silverware basket removably mounted within the wash chamber of said tub in either a first configuration or a second configuration depending upon the configuration selected for dishwasher operations, said silverware basket comprising a back wall;

a front wall spaced apart from said back wall; and a pair of transverse walls extending between and connecting said back wall and said front wall;

wherein, said front wall and said pair of transverse walls define the outer profile of said silverware basket, said front wall forming an angel $\phi_1$ with a first portion of each of said transverse walls, wherein the angle $\phi_1$ is greater than ninety degrees; and wherein, said back wall and said pair of transverse walls define the inner profile of said silverware basket, said back wall forming an angel $\phi_2$ with a second portion of each of said transverse walls, wherein the angle $\phi_2$ is greater than ninety degrees;

wherein, in the first configuration, said silverware basket is mounted to a front of said rack assembly such that said silverware basket is disposed between said rack assembly and said door along the transverse direction when said door is in the closed position; and wherein, in the second configuration, said silverware basket is mounted to said door.

14. The dishwasher appliance of claim 13, wherein said door comprises:

an inner door panel, said inner door panel comprising:

a connecting portion; and a pair of sidewalls that extend away from said connecting portion along the transverse direction when said door is in the closed position;

wherein, said connecting portion and said pair of sidewalls define the contour of said door.

15. The dishwasher appliance of claim 14, wherein said connecting portion forms an angle $\theta$ with each of said sidewalls, wherein the angle $\theta$ is greater than ninety degrees.

16. The dishwasher appliance of claim 14, wherein said front wall is positioned adjacent and faces said inner door panel and at least a portion of each of said pair of transverse walls is positioned adjacent and faces a respective one of said pair of sidewalls in the first configuration, wherein said back wall is positioned adjacent and faces said inner door panel and at least a portion of each of said pair of transverse walls is positioned adjacent and faces a respective one of said pair of sidewalls in the second configuration.

17. The dishwasher appliance of claim 14, wherein said front wall is spaced apart from said inner door panel by a fixed distance and at least a portion of each of said pair of transverse walls is spaced apart from a respective one of said pair of sidewalls by about the same amount as the fixed distance in the first configuration, wherein said back wall is spaced apart from said inner door panel by a set distance and at least a portion of each of said pair of transverse walls is spaced apart from a respective one of said pair of sidewalls by about the same amount as the set distance in the second configuration.

* * * * *